US007275529B2

(12) United States Patent
Boys

(10) Patent No.: US 7,275,529 B2
(45) Date of Patent: Oct. 2, 2007

(54) INCENDIARY PROJECTILE LAUNCHER

(75) Inventor: Cyril T. Boys, 2001 Flightway Dr., Atlanta, GA (US) 30341

(73) Assignee: Cyril T. Boys, Doraville, GA (US)

( * ) Notice: Subject to any disclaimer, the term of this patent is extended or adjusted under 35 U.S.C. 154(b) by 369 days.

(21) Appl. No.: 11/049,438

(22) Filed: Feb. 2, 2005

(65) Prior Publication Data

US 2006/0169263 A1 Aug. 3, 2006

(51) Int. Cl.
*F41B 11/00* (2006.01)

(52) U.S. Cl. ..... 124/66

(58) Field of Classification Search ..... 124/66–68; 169/33, 47

See application file for complete search history.

(56) References Cited

U.S. PATENT DOCUMENTS 4,696,347 A * 9/1987 Stolov et al. ..... 169/46
6,151,824 A * 11/2000 Clayton ..... 42/54
6,431,465 B1 * 8/2002 Yie ..... 239/88
6,860,187 B2 * 3/2005 O'Dwyer ..... 89/127
2004/0238183 A1 * 12/2004 Roesch et al. ..... 166/380

OTHER PUBLICATIONS

USDA Forest Service; Technology and Development Program; pp. 1-20; Aug. 1997.

"Firing Techniques" by Forest Protection Bureau at www.flame.fl-dof.com/Env/RX/guide/techniques.html; pp. 1-10; Feb. 1989.

McGuffog T. he "how-to" of firebreaks and aerial burns; pp. 1-5; Fire management; firebreaks and aerial burns. (no publication date available).

Operations Handbook for Premo MK III Aerial Ignition System Operations Handbook, pp. 1-21. Year of manufacture: 2004.

* cited by examiner

*Primary Examiner*—Troy Chambers

(57) ABSTRACT

A projectile launcher is provided. One aspect provides a device for launching projectiles comprising a slide, a barrel, and a pivoting element configured so that a delivery element contacts the barrel and delivers a catalyst or reactant to a projectile to be launched.

20 Claims, 5 Drawing Sheets

INCENDIARY PROJECTILE LAUNCHER

BACKGROUND

1. Technical Field

The present disclosure is generally directed to systems and methods for delivering projectiles, in particular to devices for launching incendiary projectiles.

2. Related Art

In 2003 wildland fires in the United States burned 4,918,088 acres. The cost to fight these fires is estimated at $1,326,138,000. Accordingly, methods for fighting fires as well as preventing fires can conserve financial resources as well as preserve life and natural resources. One such method includes a technique known as spot-firing.

During the early 1960s, Australian foresters developed a spot-firing technique using ignition devices dropped from aircraft onto 5,000- to 10,000-acre blocks of eucalyptus forests to ignite fires to consume the litter and reduce the fire hazard. This early system consisted of a small plastic capsule containing potassium permanganate. A syringe was used to inject ethylene glycol into the plastic capsule, and then the charged device was dropped from an aircraft. The exothermic reaction resulted in spot fires where the device landed.

The pharmaceutical vials used by the Australians to contain the potassium permanganate were satisfactory for manual dispensers, but their irregular shape caused malfunctions when used in faster machines. The Alberta Department of Land Management and Forest, Equipment Development Section, introduced a spherical container.

Commercially available aerial ignition systems use a plastic sphere dispenser. In these systems, balls containing potassium permanganate are placed into the machine and injected with glycol. The ensuing chemical reaction causes the balls to ignite in 20 to 30 seconds. As the balls are dropped, they create a burn line. With an operator sitting in the back seat with the dispenser, and a pilot and "burn boss" up front, the helicopter loiters along the fire while the burn boss signals when to drop the balls. Although aerial ignition systems are useful for generating spot fires, they suffer from certain limitations. For example, aerial ignitions systems are typically motorized and mounted to a helicopter. These systems are not adaptable for ground ignition because of their large size, lack of mobility, and power requirements.

SUMMARY

In general, aspects of the present disclosure provide systems and methods for delivering or launching projectiles, in particular, incendiary projectiles. One aspect provides a device for launching projectiles comprising a slide and a barrel. The slide optionally includes a track for guiding the barrel along the slide. The device also comprises a pivoting element mounted to the barrel. The pivoting element comprises a delivery element on a first end of the pivoting element, and a bearing on a second end of the pivoting element. The pivoting element can be configured so that the delivery element contacts the barrel as the bearing moves up an arched ramp fastened to a side panel mounted to the slide. Contact between the delivery element and the barrel delivers a catalyst or reactant to a projectile to be launched.

The disclosed systems and methods are suitable for setting controlled burn fires, for example during firefighting operations. Spot fires can be advantageously ignited by an individual at ground level using the disclosed systems and methods. Some aspects include spring-loaded pistons for ejecting the projectiles for predetermined distances.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
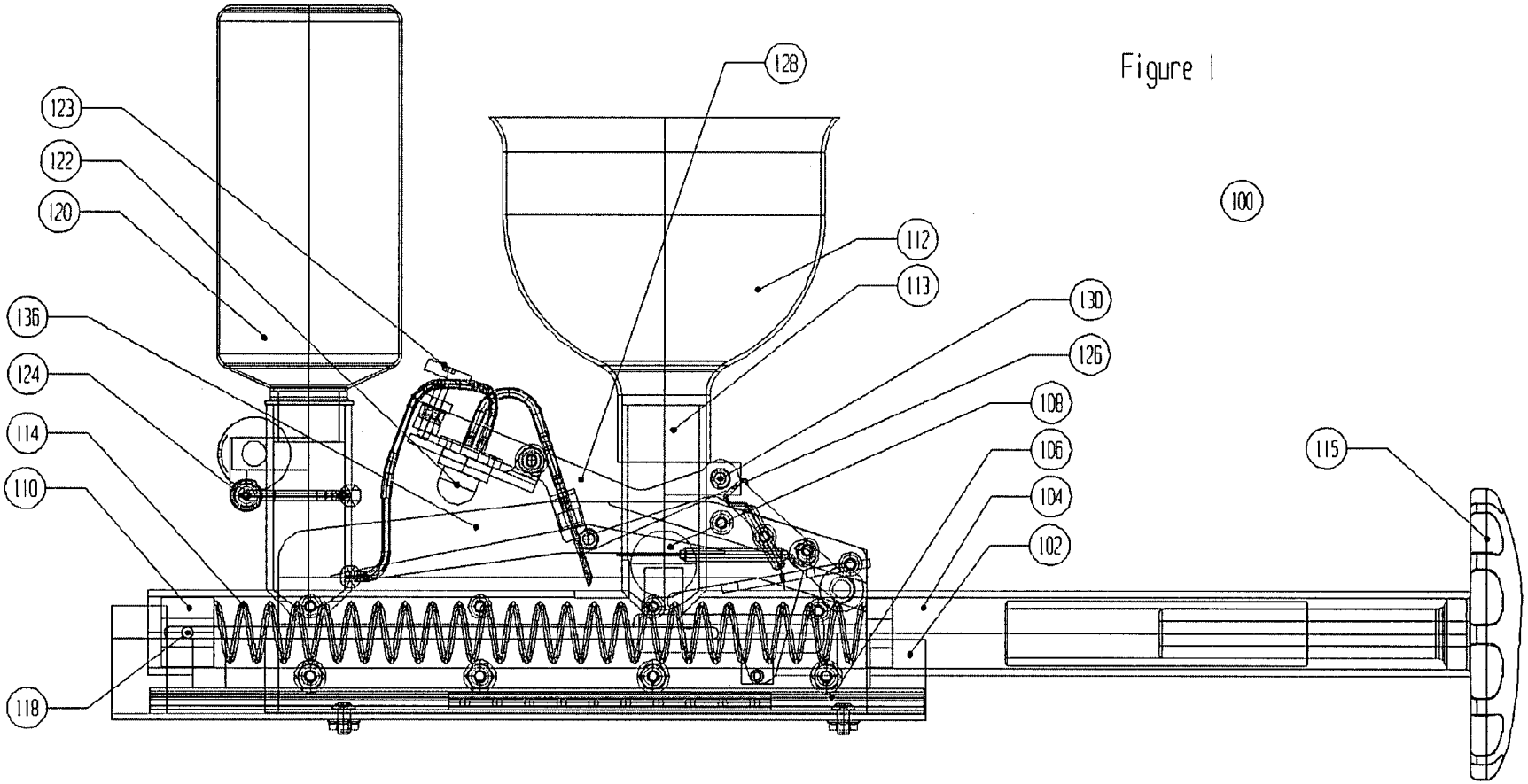
FIG. 1 shows an exemplary embodiment of a projectile launcher.

Systems and methods for delivering or launching projectiles are provided. One embodiment provides a device for combining a reactant or catalyst with a projectile and launching the projectile. Material in the projectile reacts with the reactant or catalyst to generate heat leading to ignition or combustion of the projectile and/or material in contact with the projectile. The disclosed systems and devices can be used to generate spot fires, for example as part of a firefighting operation.

One embodiment provides a device in which a spring-loaded piston is manually compressed during a compression stroke. After the spring is fully compressed, a projectile enters the barrel of the device and is injected with a catalyst or reactant during the injection stroke. At the end of the injection stroke, and after the projectile has been injected with the catalyst or reactant, the spring-loaded piston is manually released and the projectile is launched.

Embodiments of the disclosed devices and methods can be used at ground level for igniting materials in predetermined locations. Some embodiments provide projectile launchers comprising spring-loaded pistons that can be manually reset and calibrated to launch projectiles at predetermined ranges. The projectiles typically include incendiary material that when combined with a reactant or catalyst result in an exothermic reaction. The combination of reactant or catalyst with incendiary material can be formulated to result in a delayed combustion reaction.

A representative projectile includes, but is not limited to a projectile comprising incendiary material. Generally, the incendiary material ignites or combusts when combined with a reactant or a catalyst. An exemplary incendiary material includes, but is not limited to potassium permanganate. An exemplary catalyst or reactant includes, but is not limited to alkyl glycols such as ethylene glycol or glycerine. It will be appreciated that any reactant or catalyst may be combined with the projectile provided the combination of the reactant or catalyst with at least a part or component of the projectile results in an exothermic reaction sufficient to ignite a fire or combust.

In one embodiment, a catalyst or reactant is selected that induces a delayed exothermic reaction when combined with the incendiary material. For example, a reactant can be selected so that a predetermined amount of time elapses before the exothermic reaction occurs or reaches a temperature sufficient to ignite a fire, for example to ignite a casing enclosing the incendiary material. Additionally, the amount of reactant or catalyst combined with the incendiary material can be adjusted to vary the amount of time it takes the exothermic reaction to occur or reach a predetermined temperature. In one embodiment, combustion occurs about 20 seconds to about 30 seconds after combining the reactant or catalyst with the incendiary material.

Suitable projectiles for use with the disclosed systems and methods include, but are not limited to spherical projectiles, for example spherical projectiles of about 1" in diameter. Typically, the spherical projectiles comprise a polymer casing, for example plastic, nylon, polyester, polyacrylate, acrylamide, or polycarbonate enclosing incendiary material such as potassium permanganate. The casing can be impermeable to moisture to prevent reactants from reacting with the enclosed incendiary material or degradation of the incendiary material. In one embodiment, about 3 grams or less of potassium permanganate is contained in the sphere. Suitable space is left in the sphere to accommodate the reactant or catalyst. In operation, a catalyst or reactant, preferably a fluid catalyst or reactant such as ethylene glycol or glycerine, is delivered to the interior of the sphere, for example by injection. After delivery, the reactant or catalyst reacts with the incendiary material ultimately resulting in combustion. The reactant or catalyst can be formulated so that combustion occurs at least about 10 seconds after being ejected from the disclosed device. The formulation can include the addition of a delay-release material so that the reactant or catalyst is slowly released and able to react with the incendiary material. Delayed-release materials are known in the art.

Turning now to the drawings, FIG. 1 shows one embodiment of an exemplary projectile launcher 100 in an uncocked configuration. In this embodiment, launcher 100 comprises slide 102 and barrel 104. Slide 102 receives barrel 104 along track 106. Track 106 guides barrel 104 as barrel 104 moves along track 106 when launcher 100 is cocked and when projectile 108 is ejected. One embodiment provides a launcher having piston 110 positioned within barrel 104 for ejecting projectile 108. Piston 110 provides sufficient force against projectile 108 to launch projectile 108. Several methods of applying force to projectile 108 using a piston are known in the art and can be used with the disclosed device. Piston 110 can be moved by a spring 114, compressed gas, hydraulic device, combustion, or any other known means for transferring a sufficient amount of force from piston 110 to projectile 108 to eject projectile 108. The amount of force delivered to the projectile can be modulated, for example by adjusting spring tension using an adjustment knob 115.

In one embodiment, projectile 108 is loaded into launcher 100 via hopper 112. Hopper 112 typically comprises a hemispheric base and a conduit 113, for example a conduit 113 at the nadir of the hemisphere, connecting hopper 112 to barrel 104. The conduit 113 generally has a diameter sufficient to allow projectile 108 to drop through the conduit 113 into barrel 108. In one embodiment, projectile 108 is prevented from entering barrel 108 unless launcher 100 is cocked. In this embodiment, piston 110 or mainspring 114 extends beyond the opening of the conduit 113 into barrel 104 when launcher 100 is uncocked. As main spring 114 is compressed, piston 110 moves laterally in barrel 104 until catch 116 catches positioning pin 118. Catch 116 is generally pivotally mounted to barrel 104 and configured so that piston 110 and main spring 114 do not obstruct conduit 113 connecting hopper 112 to barrel 104 when catch 116 catches position pin 118.

Launcher 100 also includes a reservoir 120 for holding a catalyst, reactant, fluid, or a combination thereof for promoting or inducing an exothermic reaction when combined with incendiary material of the projectile. Typically, the catalyst or reactant is a fluid such as ethylene glycol. Reservoir 120 can be in fluid communication with a delivery element 122 using convention tubing. Delivery element 122 can be a pump, trigger, actuator, or similar device that assists in the delivery of the reactant or catalyst to the projectile. Typically delivery element 122 is a pump that forces fluid through the tubing when the pump is compressed. Pump 122 is mounted onto one end of pivoting element 128 and is in fluid communication a needle 126 or sharpened narrow-bore tube capable of delivering the catalyst or reactant to the incendiary material of projectile 108. An adjustment knob 123 can be used to modulate the amount of catalyst or reactant delivered by delivery element 122. Generally, the catalyst or reactant is delivered to the interior of projectile 108 by puncturing an outer casing of the projectile. Check valve 124 allows air into reservoir 120 as needed to prevent buildup of a vacuum as the catalyst or reactant is removed from the reservoir and delivered to the projectile.

Pivoting element 128 is pivotally mounted on to conduit 113 or barrel 104 by bearing 130. As noted above, pump 122 is mounted on one end of pivoting element 128 and bearing 132 is located on the opposite end of pivoting element 128. Pivoting element 128 is configured to pivot at bearing 130 so that as bearing 132 moves up and away from barrel 104, pump 122 moves down and towards barrel 104.

Figure 2A:
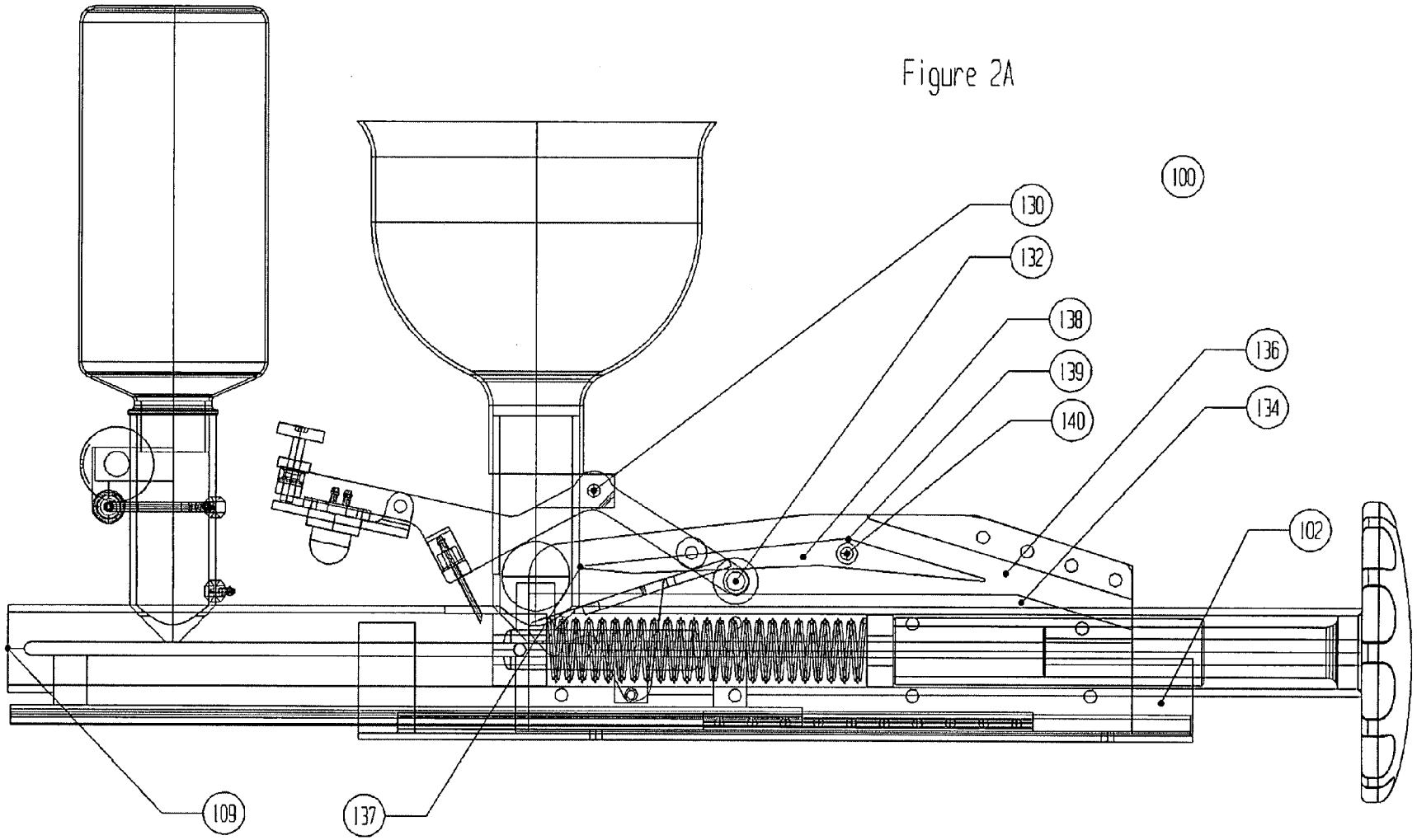
FIG. 2A shows an exemplary embodiment of a projectile launcher during the compression stroke.
Figure 2B:
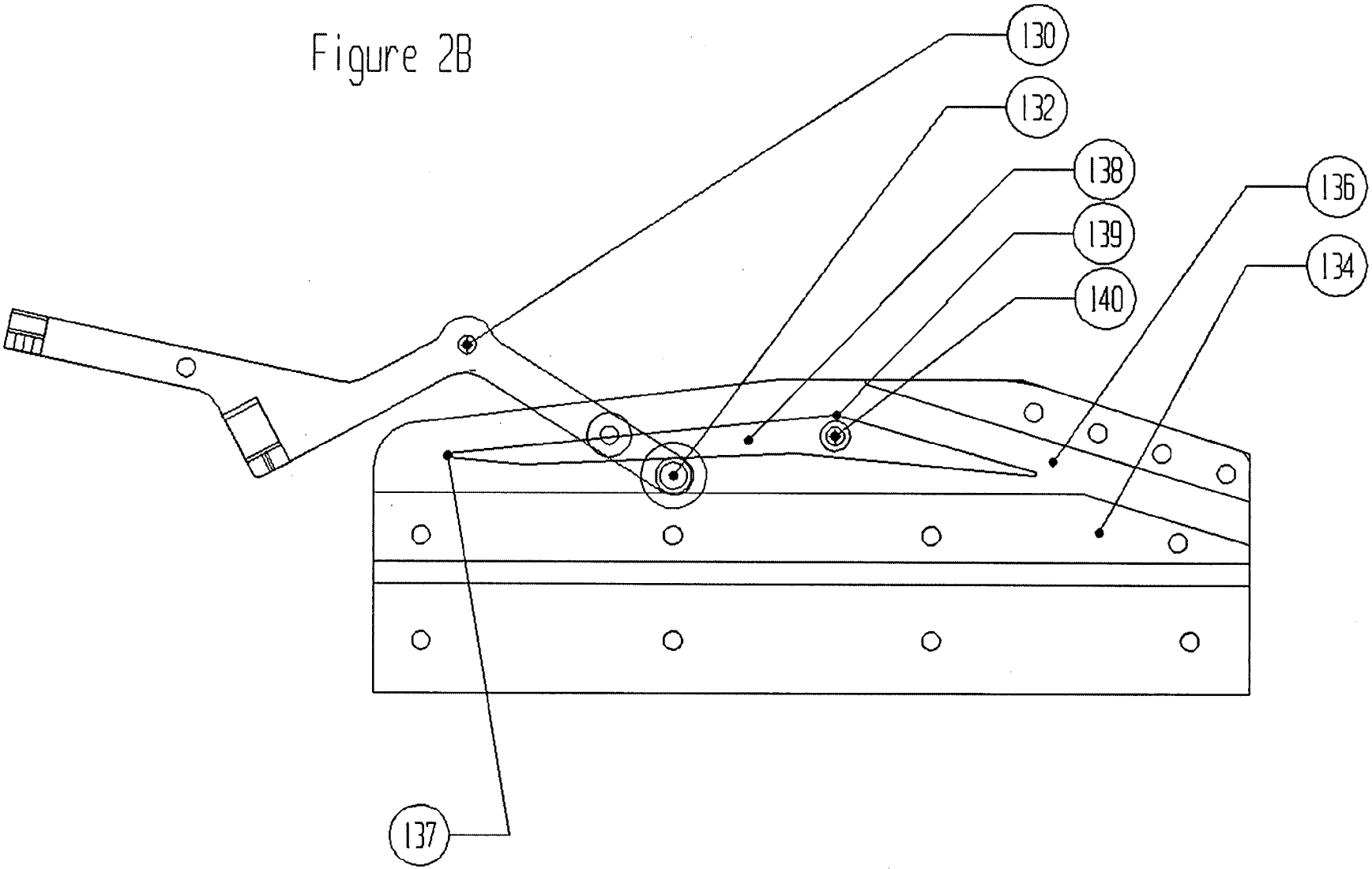
FIG. 2B shows an exemplary pivoting element in operation with a side panel.
Figure 3:
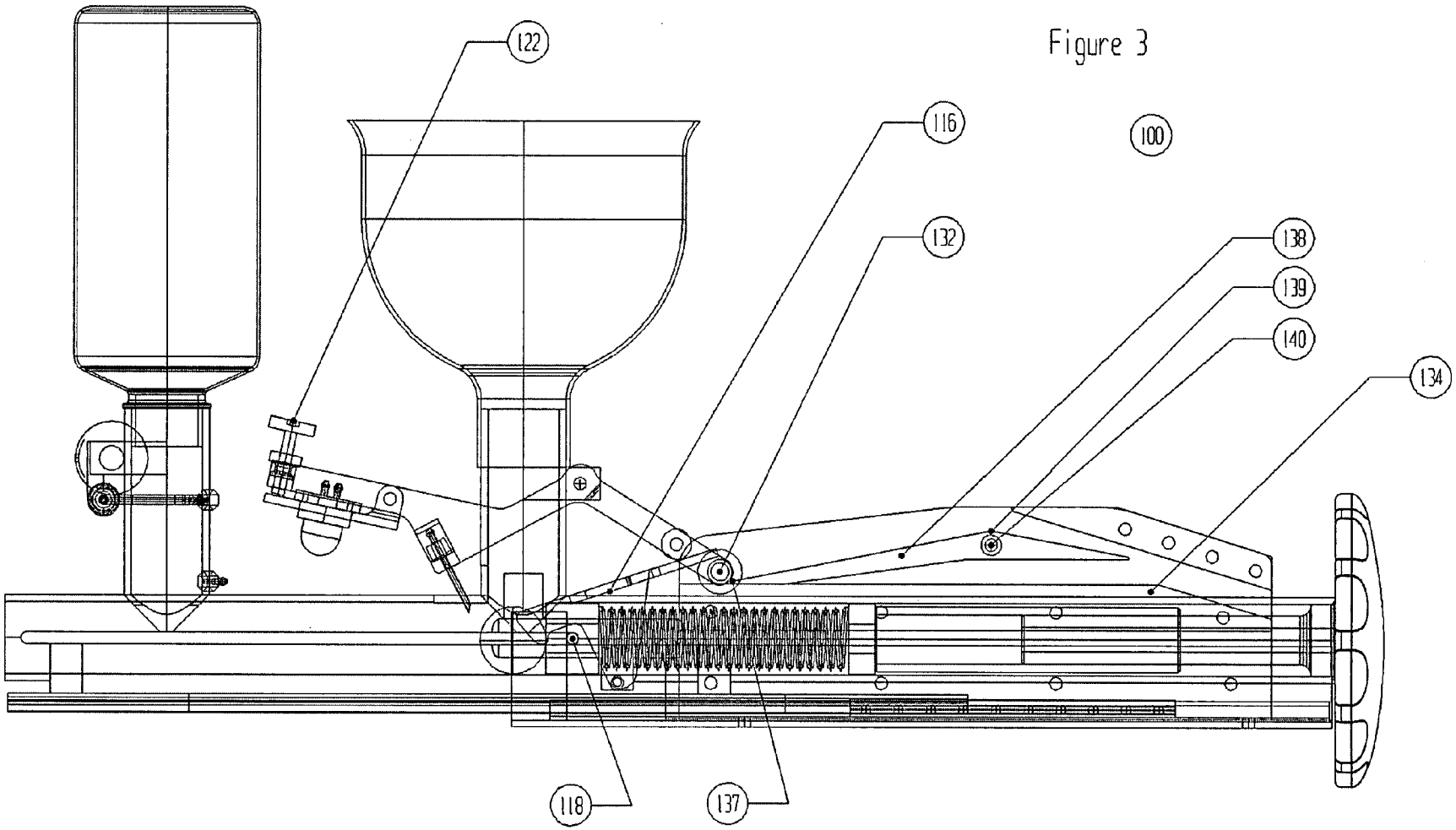
FIG. 3 shows an exemplary embodiment of a projectile launcher between the compression stroke and the injection stroke.

FIG. 2 shows exemplary launcher 100 as main spring 114 is compressed during the compression stroke. During the compression stroke, slide 102 moves along barrel 104 towards adjustment knob 115 to compress main spring 114 and cock the launcher. As slide 102 moves towards adjustment knob 115, bearing 132 moves along guide 134 mounted on to side panel 136. Side panel 136 also comprises a ramp 138, for example an arched ramp having and an apex 139 at bearing 140, pivotally mounted to side panel 136 by bearing 140. It will be appreciated that a second side panel can be mounted opposite side panel 136. In one embodiment a spring mechanism applies sufficient force to ramp 138 so that ramp end 137 of ramp 138 contacts guide 134 when launcher 100 is uncocked and/or main spring 114 is relaxed or not compressed. During the compression stroke, bearing 134 travels below ramp 138 and above guide 134 towards muzzle 109 of barrel 104. When bearing 132 passes ramp end 137, ramp end 137 contacts guide 134 and catch 116 catches positioning pin 118 (FIG. 3). Additionally, when main spring 114 is fully compressed, conduit 113 is no longer obstructed and projectile 108 can drop into barrel 104.

FIG. 3 shows exemplary launcher 100 with main spring 114 fully compressed. FIG. 3 shows that bearing 132 has moved past ramp end 137 during the compression stroke. A spring mechanism causes ramp 138 to pivot at bearing 140 and resume contacting guide 134.

Figure 4:
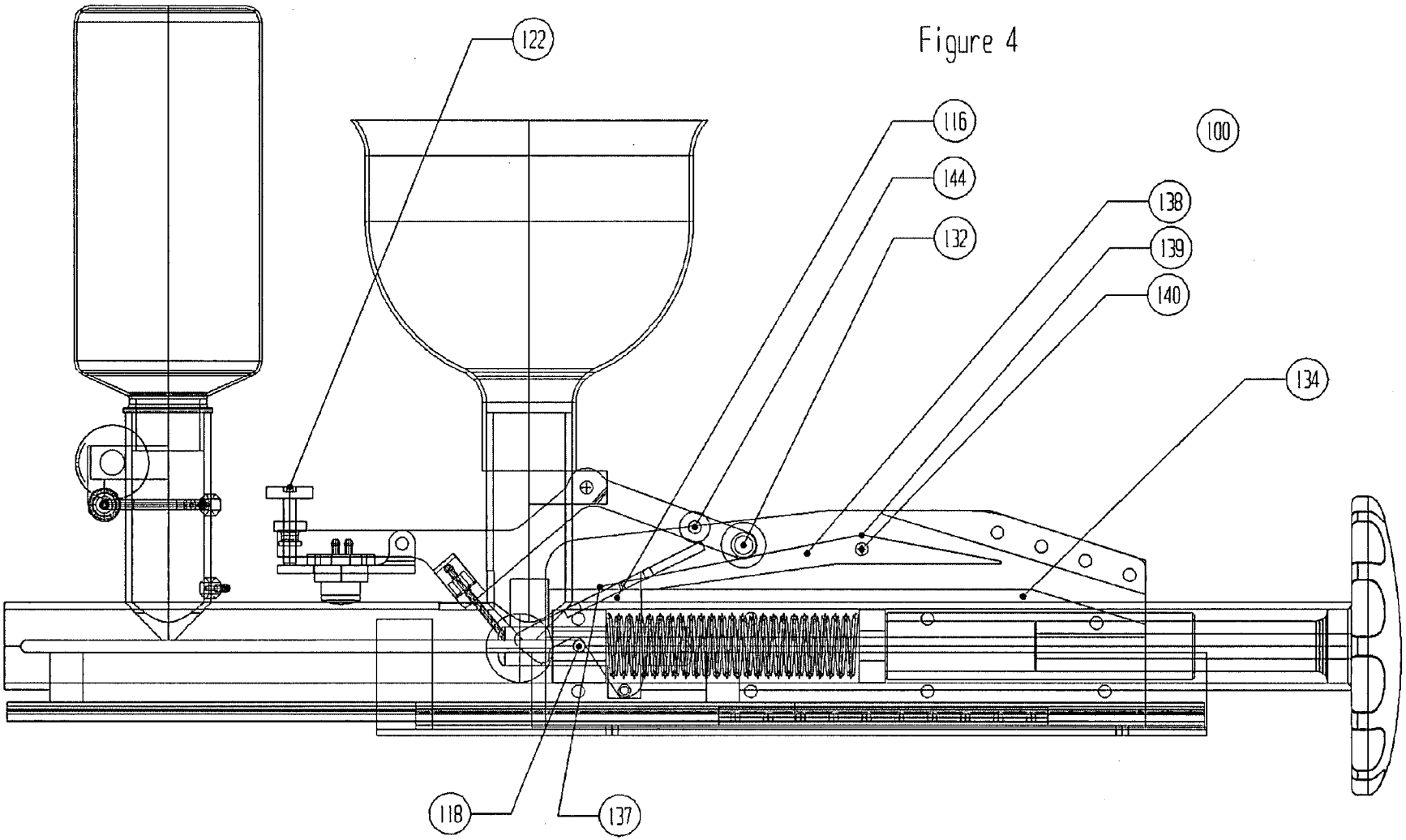
FIG. 4 shows an exemplary embodiment of a projectile launcher during the injection stroke.

FIG. 4 shows exemplary launcher 100 during the injection stroke. During the injection stroke, slide 102 is moved toward muzzle 109 causing bearing 132 to travel up ramp 138. As bearing 132 travels up ramp 138, pivoting element 128 pivots at bearing 130 causing pump 122 to come into contact with barrel 104 and needle 126 to puncture projectile 108. The compression of pump 122 against the surface of barrel 104 cause a predetermined amount of reactant or catalyst to be delivered to projectile 108 via needle 126. The volume or amount of reactant or catalyst to be delivered can be modulated by adjusting pump 122 with pump adjustment knob 124. In one embodiment, the predetermined amount of reactant or catalyst will be delivered to projectile 108 before bearing 132 passes the apex of arched ramp 138.

After bearing 132 passes the apex of ramp 138, a trigger bearing 144 positioned between bearing 130 and 132 contacts catch 116 to release piston 110 and eject projectile 108.

It will be appreciated that the disclosed devices optionally include handles for facilitating handling and compressing the main spring. Typically, one handle is mounted on the slide and one handle is mounted on the barrel, for example at the neck of the reactant or catalyst reservoir.

In operation, reservoir 120 is typically filled with ethylene glycol. Alternatively, barrel 104 can be configured with a threaded neck for receiving commercially available containers of ethylene glycol. The commercially available containers can then be screwed directly on to launcher 100. A plurality of incendiary projectiles containing potassium permanganate are loaded into hopper 112. Main spring 114 is compressed by sliding slide 102 back towards adjustment knob 115. Once main spring 114 is fully compressed, piston 110 no longer blocks conduit 113 and a projectile 108 can drop into barrel 104 immediately in front of piston 110. Slide 102 is then moved forward towards muzzle 109 to so that the projectile can be injected with reactant or catalyst. As the injection stroke is complete, trigger bearing 144 contacts catch 116 causing the piston to be released and to eject projectile 108.

The disclosed devices can be fabricated using known techniques. It is believed that virtually any durable material may be used to produced the disclosed devices including, but not limited to, metals and metal alloys such as aluminum, steel, and iron. Other suitable materials include, but are not limited to polymers such as plastics and thermoplastics.

It should be emphasized that the above-described embodiments of the present disclosure, particularly, any "preferred" embodiments, are merely possible examples of implementations, merely set forth for a clear understanding of the principles of the invention. Many variations and modifications may be made to the above-described embodiment(s) of the disclosure without departing substantially from the spirit and principles of the disclosure. All such modifications and variations are intended to be included herein within the scope of this disclosure and protected by the following claims.

What is claimed is:

1. A device comprising:

a barrel;

a slide comprising:

a track for guiding the barrel along the slide, and a panel fastened to a side of the slide, wherein the panel comprises an arched ramp; and a pivoting element mounted to the barrel, the pivoting element comprising:

a pump on a first end of the pivoting element, and a bearing on a second end of the pivoting element, wherein the pivoting element is configured so that the pump contacts the barrel as the bearing moves up the ramp and delivers a catalyst to a projectile to be launched.

2. The device of claim 1, further comprising a piston within the barrel for ejecting the projectile.

3. The device of claim 2, wherein the piston is spring-loaded.

4. The device of claim 1, wherein the projectile comprises an incendiary material.

5. The device of claim 4, wherein the incendiary material comprises potassium permanganate.

6. The device of claim 1, wherein the catalyst induces an exothermic reaction.

7. The device of claim 1, wherein the catalyst comprises ethylene glycol.

8. A projectile launcher comprising:

a barrel a slide comprising:

a track for guiding the barrel along the slide, and a panel mounted to a side of the slide, the panel comprising:

an arched ramp having an apex separating a first and a second side of the ramp, and a guide positioned below the ramp; and a pivoting element mounted to the barrel comprising a pump on a first end and a bearing on a second end, wherein the pivoting element is configured so that the pump contacts the barrel as the bearing travels up the ramp causing a reactant to be delivered to a projectile in the barrel.

9. The projectile launcher of claim 8, further comprising a hopper for loading the projectile in the barrel.

10. The projectile launcher of claim 8, further comprising a piston within the barrel for ejecting the projectile.

11. The projectile launcher of claim 10, wherein the piston is spring-loaded.

12. The device of claim 8, wherein the projectile comprises an incendiary material.

13. The device of claim 12, wherein the incendiary material comprises potassium permanganate.

14. The device of claim 8, wherein the reactant induces an exothermic reaction.

15. The device of claim 8, wherein the reactant comprises ethylene glycol.

16. A projectile launcher comprising:

a barrel;

a slide comprising:

(1) a track for guiding the barrel along the slide, and (2) a panel mounted to a side of the slide, the panel comprising:

(i) an arched ramp having an apex between a first and a second side of the ramp and pivotally mounted to the panel, and (ii) a guide positioned below the ramp, wherein a spring element causes the first end of the ramp to contact the guide;

a hopper mounted to the barrel for delivering the projectile to the barrel;

a piston within the barrel for ejecting the projectile;

a pivoting element mounted to the barrel comprising a pump on a first end and a bearing on a second end; and a reservoir in fluid communication with the pump;

wherein the projectile launcher is configured so that as the bearing travels under the ramp and along the guide, the piston is cocked, and as the bearing travels up the first side of the ramp, the pump contacts the barrel and delivers a reactant to the projectile.

17. The projectile launcher of claim 16, wherein the projectile launcher is configured so that as the bearing travels down the second side of the ramp, the piston is released and ejects the projectile.

18. The device of claim 16, wherein the projectile comprises an incendiary material.

19. The device of claim 18, wherein the incendiary material comprises potassium permanganate.

20. The device of claim 16, wherein the reactant comprises ethylene glycol.

* * * * *